United States Patent [19]

Lavender et al.

[11] Patent Number: 4,568,255

[45] Date of Patent: Feb. 4, 1986

[54] PERISTALTIC ROLLER PUMP

[75] Inventors: Ardis Lavender, Chappaqua; Emidio Di Martino, Bronx, both of N.Y.

[73] Assignee: Armour Pharmaceutical, Tarrytown, N.Y.

[21] Appl. No.: 672,571

[22] Filed: Nov. 16, 1984

[51] Int. Cl.[4] ..... F04B 43/12

[52] U.S. Cl. ..... 417/477

[58] Field of Search ..... 417/474, 475, 476, 477

[56] References Cited

U.S. PATENT DOCUMENTS

| | | | |
|---|---|---|---|
| 2,804,023 | 8/1957 | Lee | 417/477 |
| 2,909,125 | 10/1959 | Daniels | 417/477 |
| 3,787,148 | 1/1974 | Kopf | 417/477 |
| 3,885,894 | 5/1975 | Sikes | 417/477 |
| 4,095,923 | 6/1978 | Cullis | 417/477 X |
| 4,363,609 | 12/1982 | Cosentino | 417/477 |
| 4,487,558 | 12/1984 | Troutner | 417/477 |

*Primary Examiner*—Richard E. Gluck

*Attorney, Agent, or Firm*—Scully, Scott, Murphy & Presser

[57] ABSTRACT

The Specification discloses an improved peristaltic Roller Pump for pumping fluids through a flexible tubing. First and second surge release radii are formed on a semicylindrical reaction wall to minimize back surge or fluctuations in pump line pressure as the pump rollers engage and disengage the reaction wall. Improved sloped or angles sweep vanes are provided in front of each roller for collecting the tubing and directing it through a discharge throat into the path of the oncoming roller thereby minimize jamming, kinking or other entanglement of small diameter tubing when used in a roller pump. A novel and inexpensive construction arrangement provides for quick simple and precise adjustment of both rollers simultaneously to enable the operator to quickly adjust the pump, or to disassemble the pump for cleaning or sterilization. The pump utilizes a pair of reciprocating pump arms which are actuated by a single cam means to provide for a simultaneous and identical adjustment of each of the rollers with respect to the pump wall.

15 Claims, 11 Drawing Figures

PERISTALTIC ROLLER PUMP

BACKGROUND OF THE INVENTION

Peristaltic roller pumps are generally used whenever the pump environment requires that the pump mechanism not contact the fluid to be pumped. Such pumps are widely used in the medical profession for pumping blood and other fluids wherein it is desired to maintain the blood or fluid in a sterile environment without the possibility of contamination from the pump mechanism.

While the art of designing and building roller pumps has been relatively well developed over the years, problems associated with pump surge, undue complexity, and entanglement or kinking of the flexible tubing still persist.

U.S. Pat. Nos. 2,804,023 to J. C. Lee entitled "Pump" and 3,787,148 to Kopf entitled "Roller Pump" both disclose concepts for minimizing surge and providing a relatively constant driving torque or pump output. Kopf, in particular, discloses a pair of rollers on reciprocating pump arms 14 and 15, which are spaced 180° from one another, and which engage a semicylindrical wall. Lead in and lead out ramps 60, 61 are provided.

Applicant has found, contrary to Kopf's teaching, that surge may be minimized by rendering the semicylindrical wall a full 180°, and providing first and second surge radii beyond the 180° arc, as will be hereinafter more fully described.

U.S. Pat. Nos. 3,885,894 to Sikes entitled "Roller-Type Blood Pump" and 4,095,923 to Cullis entitled "Peristaltic Pump with Accommodating Rollers" are representative of a large number of patents which disclose fingers or arms in front of the pump rollers to assist in positioning the flexible tubing against the semicylindrical wall for roller engagement. The Sikes reference, in particular, discloses rectilinear sweep arms that extend outwardly from the rotor in front of the rollers and their reciprocating pump arms. It has been found, however, that even with the arms of the type generally disclosed by Sikes and Cullis, small diameter tubing may still become jammed or kinked by the mechanism. Applicants have found that by replacing these rectilinear arms with sloped or angled sweep vanes, the problems of jamming or kinking are eliminated.

U.S. Pat. No. 4,174,193 to Sakakibara entitled "Peristaltic Pump with Hose Positioning Means in Pressure Adjustment Apparatus" discloses a pump having means to rapidly adjust the position of the rollers with respect to the pump wall. Applicants have developed a structure that may be inexpensively fabricated from a minimum number of moving parts that will enable precise placement of the rollers with respect to the pump wall with a single adjustment. The mechanism utilized, as will be hereinafter more fully described, is substantially simpler than the mechanisms disclosed in the foregoing patent.

SUMMARY OF THE INVENTION

The present invention is an improved peristaltic roller pump for pumping fluids through a flexible tubing with the following advantages over prior art peristaltic roller pumps.

(a) An inexpensive means for minimizing back surge or fluctuations in pump line pressure as the pump rollers engage and disengage a semicylindrical reaction wall.

(b) Improved sloped or angled sweep vanes in front of each roller for collecting the tubing and directing it through a discharge throat into the path of the oncoming roller thereby minimize jamming, kinking or other entanglement of small diameter tubing when used in a roller pump.

(c) An inexpensive construction arrangement providing for a quick, simple and precise adjustment of both rollers simultaneously that will enable the operator to quickly adjust the pump, or to disassemble the pump for cleaning or sterilization.

The present invention provides an improved peristaltic roller pump having a housing with an internal semicylindrical pump reaction wall of constant radius which partially surrounds a central rotational axis. The housing also has clamps adjacent opposite ends of the semicylindrical wall to releasably secure an accurate portion of the flexible tubing against the wall and to prevent creep of tubing during pump rotation. A rotor is mounted within the housing for rotation about the central axis. The rotor and the housing are particularly adapted for releasable engagement with a base and pump motor. First and second pump rollers are mounted on reciprocal pump arms which are mounted for reciprocation within said rotor on either side of the central axis generally parallel to one another. The axis of each roller is spaced 180° from the other roller to match the 180° arc of the semicylindrical reaction wall. A single cam means is mounted between the rotor and the pump arms to position the rollers a desired distance from the pump reaction wall as the cam is rotated with respect to the rotor. A single means is used to clamp the cam means to the rotor to thereby secure the rollers in a desired driving relationship with respect to the pump wall. A first surge release radius is formed on either end of the semicylindrical pump wall with the radius being a function of the roller diameter. A second surge release radius is formed on the exterior of the first radius to further minimize pump surge with the second radius being a function of the wall thickness of the flexible tubing intended for use in the pump. The transition points between the constant radius of the semicylindrical wall and the first surge release radius are spaced 180° apart. A pair of rectilinear sloped or angled sweep vanes are mounted in front of each roller with the vanes angled to define a discharge throat with the spacing of the vanes and the throat being equal to or less than the length of the rollers immediately following the vanes. Each of the vanes has a curved exterior end that matches the curve of the semicylindrical wall as the vanes are rotated by the rotor.

It is an object of the present invention to provide a reliable and trouble free roller pump with a minimum of moving parts that will enable the operator thereof to quickly assemble and disassemble the pump for cleaning, and to easily adjust the pump to change and define the pump volume.

It is another object of the present invention to provide a roller pump that minimizes surge in normal operation.

There is still a further object of the present invention to provide a pump that will use a wide variety of tubing sizes, including very small tubing without kinking or entangling the small tubing in the rotor mechanism.

DETAILED DESCRIPTION OF THE PREFERRED EMBODIMENTS

Figure 1:
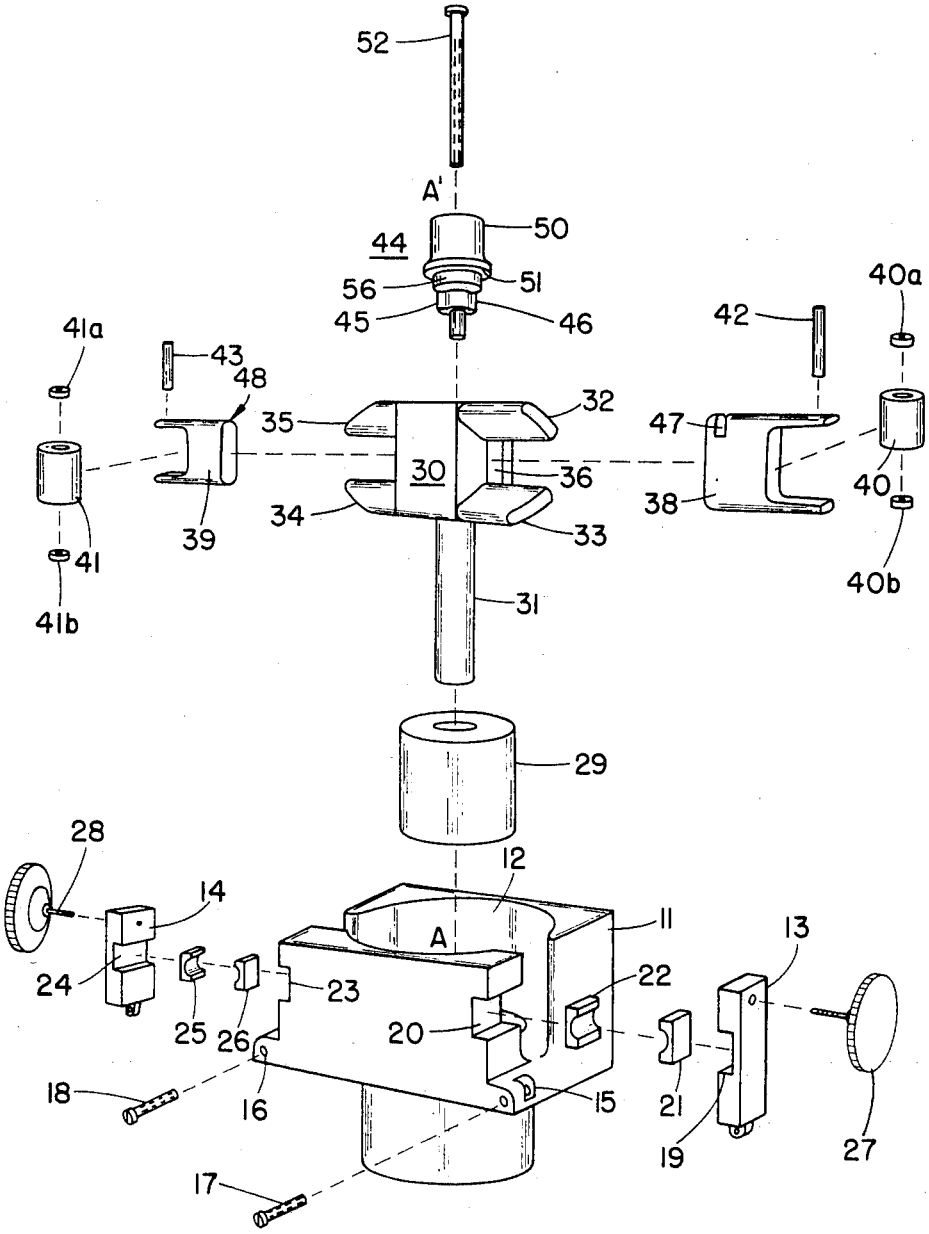
FIG. 1 is an isometric exploded view of the roller pump of the present invention illustrating the major component parts thereof.

FIG. 1 is an exploded isometric view of the improved roller pump of the present invention. As illustrated in FIG. 1, the housing 11 is formed of a single block of engineering plastic or aluminum, and defines by a semicylindrical reaction wall which extends through 180° of arc to form a reaction surface for the pump rollers. First and second pivotal gates 13, 14 are pivotively mounted to housing 11 at pivot points 15 and 16 by means of pins 17 and 18. The gate 13 and pump housing 11 have a pair of opposed cooperating recesses 19, 20 formed therein for receiving a pair of elastomeric inserts 21, 22 which releasably secure an outer portion of a flexible tubing against the pump reaction wall 12. Likewise, pivotal gate 14 and housing 11 also define a pair of notches 23 and 24 and a pair of inserts 25, 26 for releasably securing the opposite end of the tubing. The pivotable gates 13, 14 are secured at their upper end to the housing by means of thumb screws 27, 28 which threadably engage the housing 11. This method of construction enables the operator of the pump to quickly adapt the pump to various sizes of tubings by changing the inserts 21, 22 and 25, 26 each time a different tubing diameter is to be utilized.

Pump housing 11 also defines a central rotational axis A-A′ which extends vertically through the pump. The internal semicylindrical pump reaction wall 12 is of constant radius and partially surrounds the central rotational axis A-A′. A large diameter roller bearing is schematically illustrated at 29 and bearing 29 provides a large trouble free main bearing surface between the pump rotor 30 and the pump housing 11. When assembled, roller bearing 29 is received within the recessed cavity 11*a* of housing 11 as seen in FIG. 3.

Pump rotor 30 has several features which will be hereinafter more fully described in the description of FIGS. 8–10. As illustrated in FIG. 1, however, the pump rotor has a pump shaft 31 which extends downwardly through bearing 29 to engage the pump motor (not shown). Pump rotor 30 also defines a first and second pair of angled or sloped sweep vanes 32, 33 and 34, 35. Pump rotor 30 also defines a pair of slots 36 and 37 (37 not illustrated in FIG. 1) for receiving a pair of reciprocating pump arms 38 and 39. The reciprocating pump arms 38 and 39 have first 40 and second 41 pump rollers mounted therein. Each of the pump rollers 40, 41 define insert cavities (not shown) for receiving roller bearings 40*a*, 40*b* and 41*a*, 41*b*. The rollers 40, 41 rotate about a pair of shafts 42, 43 which extend through the bifurcated portions of reciprocal arms 38, 39 and rollers 40,41. Rollers 40, 41 are supported for rotation for shafts 42, 43 by means of roller bearings 40*a*, 40*b* and 41*a*, 41*b*.

Pump arms 38, 39 are mounted for reciprocation within the pump rotor 30 parallel to one another and on either side of the rotational axis A-A′ wherein the rotational axis of each of the rollers 40, 41 is spaced 180° apart around axis A-A′. The reciprocating pump arms 38, 39 are moved by means of a cam 44 which has first 45, and second 46, outwardly projecting cam surfaces which engage a pair of cam slots formed in the pump arms. Cam surface 46 engages slot 47 formed in pump arm 38, while cam surface 45 engages a slot 48 (not shown in FIG. 1). Cam 44 also has an adjustment knob 50, and a friction locking surface 51 which engages the top surface of pump rotor 30. A single threaded bolt 52 extends downwardly through cam 44 to secure the cam to rotor 30. To adjust the spacing between the pump rollers and the pump reaction wall, the bolt 52 is loosened, and the knob 52 is rotated which rotates cam 44 with respect to pump rotor 30 to reciprocally move the pump arms 38, 39 inwardly or outwardly with respect to the pump reaction wall.

Figure 2:
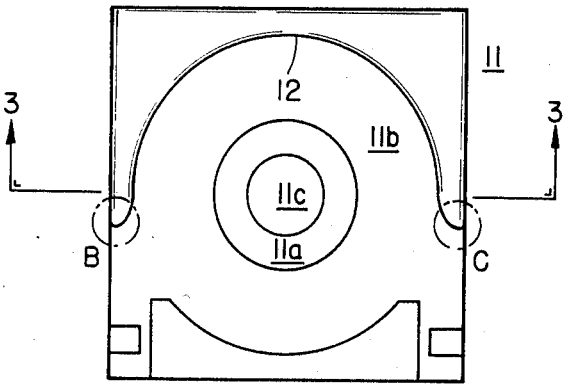
FIG. 2 is a top plan view of the rotor pump housing.
Figure 3:
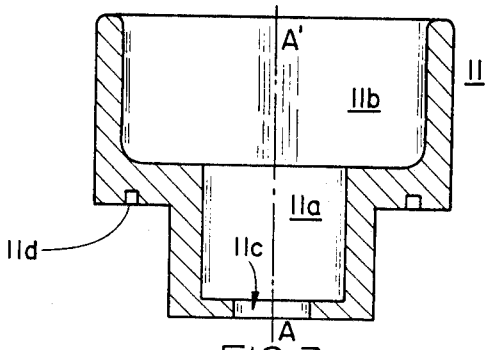
FIG. 3 is a cross sectional view of the rotor pump housing taken along section Line 3—3 in FIG. 2.

The pump housing is more fully described with respect to FIGS. 2 and 3. Pump housing 11 is formed in a single piece, fabricated either from metal or from engineering plastic such as glass-filled polyester, polyetherimide, or polyphenylene oxide. It contains two concentric cavities 11*a* and 11*b* and a central drive shaft opening 11*c*. The semicylindrical pump reaction wall 12 is defined on one interior wall of the housing and partially encloses the central rotational axis A-A′. A first and second surge release radii generally indicated by sections B and C will be more fully described with respect to FIG. 11. These surge release radii are formed on either end of the semicylindrical pump reaction wall 12 to minimize surging caused by the engagement and disengagement of rollers 40, 41 from pump reaction wall 12. If the pump provides a positive pressure to the outgoing fluid line, the surging is created as the exiting pump roller leaves the semicylindrical wall 12. If the pump provides a reduction in pressure to the incoming line, surging can be created by the entrance of the roller against the pump wall. In the improved pump described in the present invention the constant radius portion of the semicylindrical wall 12 is 180° and the rollers 40, 41 are spaced 180° from each other about the rotational axis A-A′. The pump housing 11 also defines an inner cavity 11*a* for receiving a roller bearing which receives the shaft of the rotor 30. As was indicated previously, the shaft 31 of the rotor also extends downwardly through the opening 11*c* to engage the pump motor (not shown). Formed in the under surface of pump housing 11 is a concentric recess 11*d* which receives an elastomeric gasket. This gasket prevents contamination of the pump motor or other underlying components when the pump is installed in its working environment.

Figure 4:
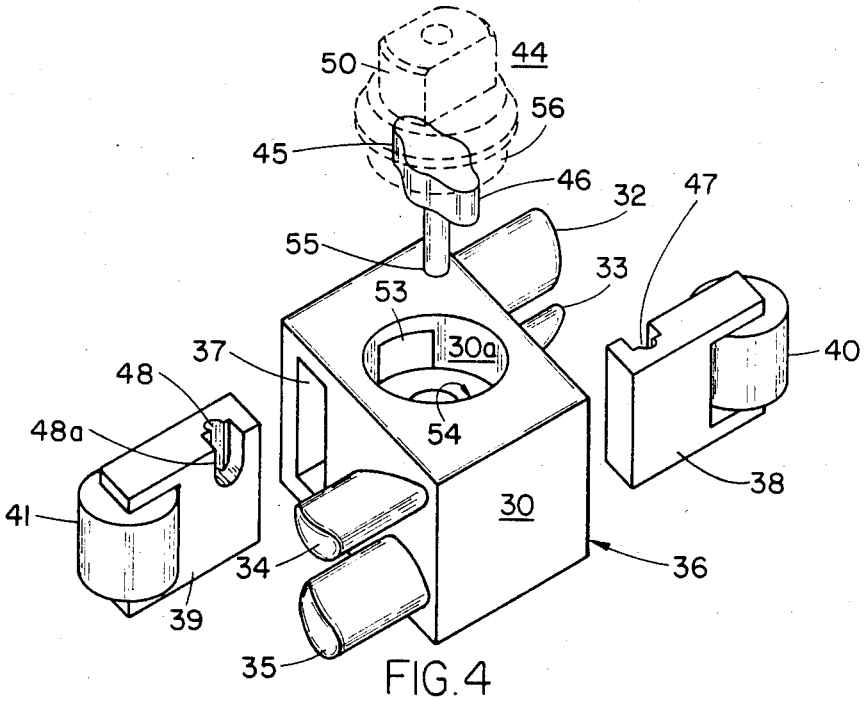
FIG. 4 is a diagrammatic exploded view illustrating the operation of the cam and pump arm assembly.

FIG. 4 is a diagrammatic exploded view illustrating the interaction between the pump rotor 30, the pump arms 38, 39, and the cam arms 45, 46 of cam 44. Reciprocal pump arms 38,39 are mounted within rotor 30 by means of the internal slots 37 and 36 (36 not illustrated in FIG. 4). When assembled, the cam slots 47 and 48 are accessable through the interior of cavity 30*a* by virtue of openings 53 and 54 (opening 54 not illustrated in FIG. 4). The cam means 44 is then dropped downwardly into the pump rotor so that cam arm 46 engages slot 47, and cam arm 45 engages slot 48. Rotation of the knob portion 50 will then cause reciprocation of the pump arms 38, 39. The entire means is then clamped together by means of a single cam locking bolt 52 (illustrated in FIG. 1) which clamps the cam 44 against rotor 30 by means of threadable engagement with the interior of rotor shaft 31. As illustrated in FIG. 4, the downwardly descending shaft 55 and the shoulder 56 provide guides for the rotation of the cam within the rotor 30. The annular flat face 51 as illustrated in FIG. 1, is then clamped against the top face of the rotor 30 of means by bolt 52. This manner of construction releasably secures the reciprocating arms 38, 39 in any desired position. When it is desired to install a different diameter of tubing, the operator merely loosens cam locking bolt 52 and rotates the knob portion 50 with respect to rotor 30 to change the relative position of rollers 40, 41 with respect to the semicylindrical pump reaction wall 12.

If the operator desires to clean the pump, the entire pump rotor assembly may be quickly disassembled for cleaning by removing a single bolt 52. The entire pump may be cleaned by removing thumb screws 27, 28 and removing the flexible tubing and lifting the pump from the pump and motor base assembly (not shown).

Figure 5:
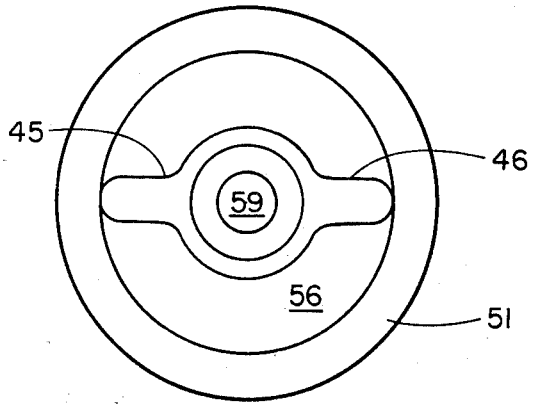
FIG. 5 is a bottom plan view of the cam mechanism.
Figure 6:
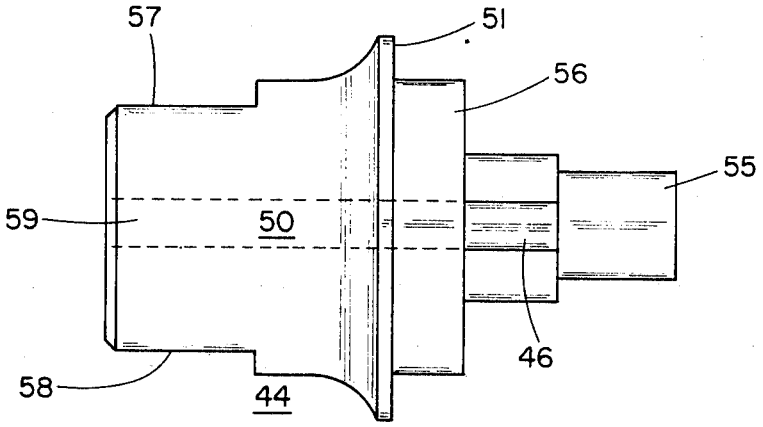
FIG. 6 is a side plan view of the cam mechanism.

The pump cam illustrated in FIGS. 5–6 may be fabricated from a single piece of metal. The knob portion 50 of the cam has two parallel surfaces 57 and 58 for easily gripping the cam with ones fingers. A center hole 59 is bored through the cam to receive the cam lock bolt 52. As illustrated previously, the cam arms 45 and 46 fit into the slots 47 and 48 defined in the pump arms. The radius of cam arm 45, and the two step radius of the slot 48*a* are necessary to permit the full motion of the cam without impinging upon the pump arm. The larger slot 48*a* also serves as a stop, and prevents excursion of the arms beyond the point at which the cam contacts the arm.

Figure 7:
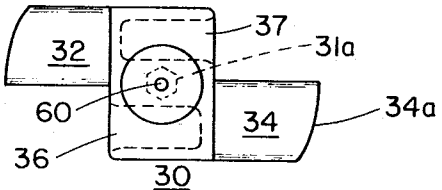
FIG. 7 is a top plan view of the rotor mechanism illustrating the angled sweep vanes.
Figure 8:
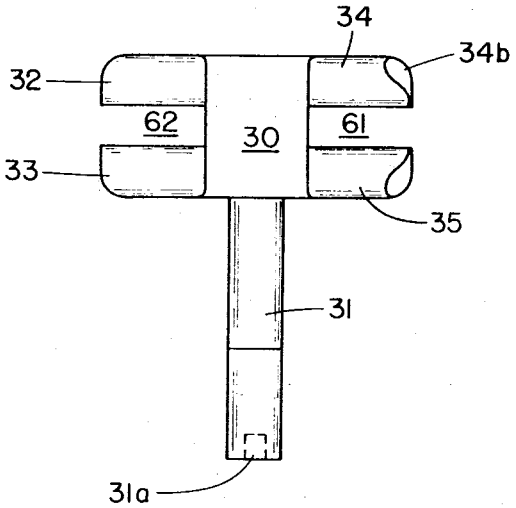
FIG. 8 is an elevation front view of the rotor mechanism illustrated in FIG. 7.
Figure 9:
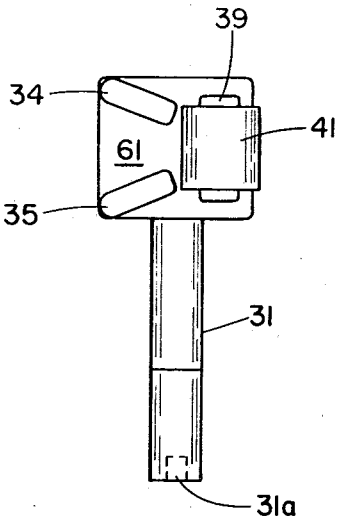
FIG. 9 is an elevation side view of the rotor mechanism illustrated in FIG. 8.

The pump rotor as illustrated in FIGS. 7–9 has a top plan view, a front elevation view, and a side elevation view. In addition, FIG. 9 illustrates the interaction of the sweep vanes 34, 35 and the pump roller 41. As illustrated in these figures, a pair of rectilinear sweep vanes is formed on either side of the pump rotor 30, immediately in front of the pump roller, as illustrated at FIG. 9. The sweep vanes are sloped or angled with respect to one another as illustrated in FIG. 9, to provide a discharge throat 61 for discharging the flexible tubing into the path of the advancing roller 41. Each of the vanes has a double contoured surface as illustrated by the curve 35*a* in FIGS. 8 and 9. This double curved surface enables the sweep vane to traverse or sweep the face of the semicylindrical wall with a tolerance of approximately 0.020 inches and insure that the flexible tubing is directed into the path of the oncoming roller 41. A similar discharge throat 62 is formed between vanes 32 and 33 in front of roller 40. As indicated previously, it has been found that when the vanes are parallel to one another, and aligned with the reciprocal access of pump arm 39, small diameter tubing may become kinked or entangled in the pump mechanism. Angling the sweep arms 34 and 35 has eliminated the problems previously associated with tangling and kinking of small diameter tubing.

As indicated in FIG. 7, a central threaded cavity 60 receives the cam locking bolt 52 to secure the cam to the pump rotor. Likewise, a hexagonal recess 31*a* formed on the rotor shaft 31 provide for engagement of the pump rotor with a stepping motor 78 via a shaft coupling or other desired drive means.

Figure 10:
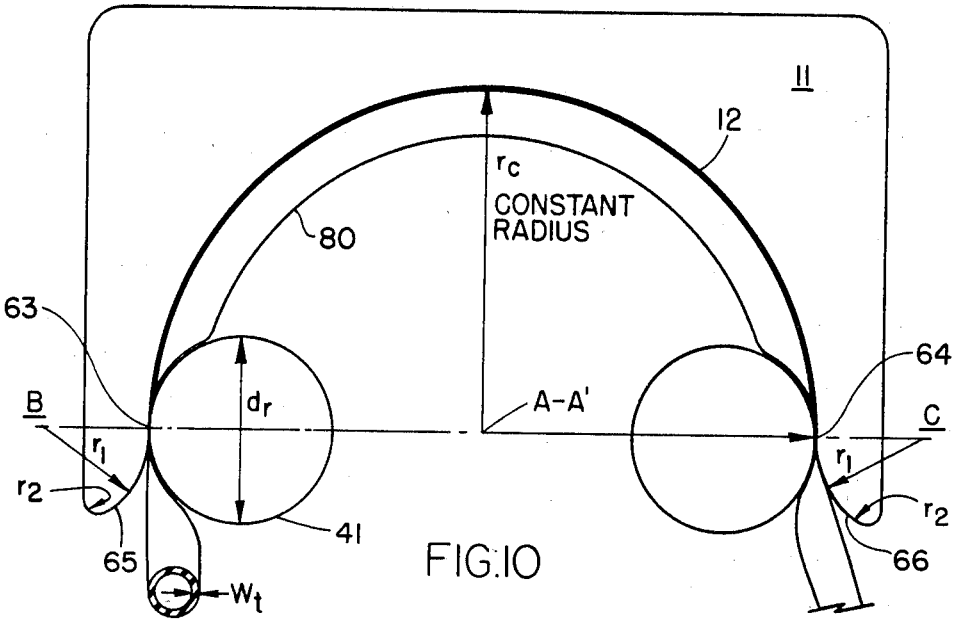
FIG. 10 is a diagrammatic view of a portion of the pump housing illustrating the surge release radii.

The surge release radii are more fully described with respect to FIG. 10. As indicated in FIG. 2, each end of the semicylindrical pump reaction wall 12 has a pair of surge release radii formed thereon. These radii have been somewhat exaggerated in FIG. 10 to more fully describe the transition points between the radii. As illustrated in FIG. 10, the constant diameter radius of the pump wall extends transition point 63 to transition point 64. A first surge release radius $r_1$ is formed on either end of the semicylindrical constant radius and are illustrated in FIG. 10 as $r_1$, beginning at transition points 63 and 64. Each of the radii $r_1$ sweeps outwardly through approximately 53° of travel to second transition points 65 and 66. A second surge release radii $r_2$ is then formed on the exterior of each of the first surge release radii $r_1$ beginning at transition points 65 and 66 and extending outwardly to the exterior of the housing 11.

The first surge release radius $r_1$ bears a predetermined functional relationship to the diameter of the roller $d_r$ schematically illustrated at 41 in FIG. 10. This functional relationship may be described as $$r_1 = d_r/2$$

Likewise the second surge release radius has a functional relationship to that of $r_1$, and the wall thickness of the tubing 80 intended for use in the roller pump. This relationship may be described as:

$$r_2 \geqq W_t \text{ and } r_2 \leqq r_1$$

wherein $r_1$ is the first surge release radius $r_2$ is a second surge release radii, and $W_t$ is the wall thickness. Each of the two surge release radii form a slightly different function, and their exact interaction is not totally understood.

In one test example of the invention, the first surge release radii and the radius of the roller were matched at 0.375 inches wherein $r_1 = d_r/2$.

The second surge release radius was formed as ¼ of that radius at 0.062. This radius was also equal to the wall thickness of the largest diameter tubing tested to date in the roller pump. As the roller rotated about the semicylindrical pump reaction wall, and reached transition point 64, tubing compression was gradually released to conform to the difference between the surface of the 0.375 radius and the roller surface. Simultaneously, the incoming roller gradually compressed the tubing on the opposite side of the semicylindrical wall in exactly the same manner. This substantially reduced the surge normally associated with roller pumps. In addition, a second surge release radii $r_2$ was found to virtually eliminate the residual surging caused by elastic deformation of the flexible tubing. Without the second radii, the elastic tubing would whip back and forth corresponding to a residual surge in line pressure. With the second surge release radii $r_2$ the whipping action was virtually eliminated and within the constraints of maximum pressure of 900 millimeters of mercury, the pump was accurate and linear within 2%.

The compound radial exit and entrance points previously described also minimize the torque requirements of the pump. With conventional prior art roller pumps, when both rollers are in contact with the pump housing, the torque requirements on the motor double. In addition, by utilizing the compound radii the torque requirements are further reduced by substituting a gradual change in torque requirements rather than an abrupt change which would occur without the radii. As a consequence, it is possible to use a smaller motor to perform a given amount of work than would otherwise be possible. In the test embodiment of the invention, the stepping motor with a microstepper control was used to drive the pump. The pump motor size was selected to provide a maximum output pressure of 900 mm of mercury. The motor required to achieve this pump action was so small that one could easily stop the pump motion with a finger in the roller path. This is not possible with conventional pump designs, since much larger motors are required to overcome the torque increase described above. In such pumps, a finger in the path of the roller would rapidly be compressed and crushed. Finally, the use of the compound radii on either side of the semicylindrical reaction wall permits loading of the pump in either direction as desired.

Figure 11:
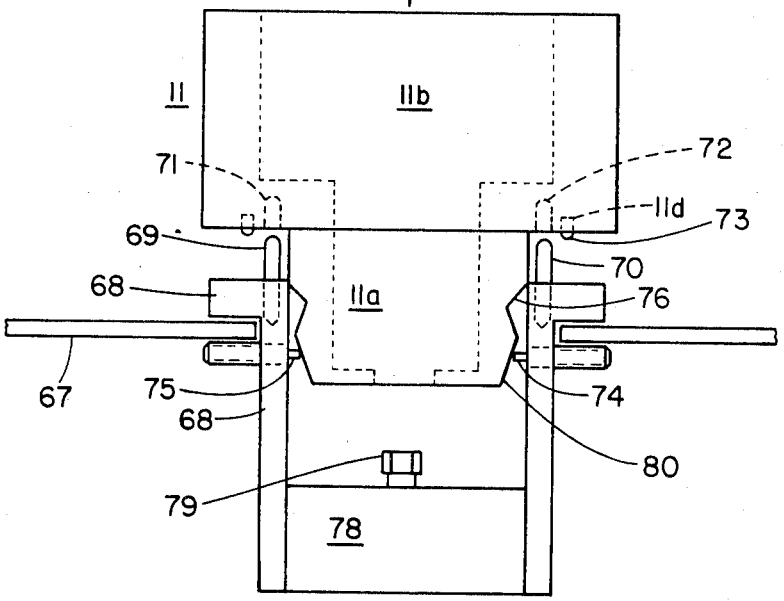
FIG. 11 is a diagrammatic view of a pump cabinet adapted to receive the pump housing of the present invention, and illustrates the quick release and positioning mechanism of the pump.

FIG. 11 illustrates a diagrammatic view of a pump cabinet, motor and quick release mechanism particularly adapted to receive the pump housing of the present invention. The pump cabinet 67 may be an independent stand-alone unit, or may be the upper planar surface of a dialysis machine or other medical device using the present invention. A receiving collar 68 is formed with at least one alignment pin 69, or as illustrated in FIG. 11 with four alignment pins, two of which are illustrated at 69 and 70. The alignment pins 69,70 prevent the rotation of the pump housing 11 when the pump rotor is energized by pump motor 78. As the pump housing 11 is dropped into the collar assembly 68, it is rotated to align the housing with pins 69,70 and after alignment, an annular cam surface 80 displaces a pair of spring-loaded pins 74, 75 outwardly. As the pump housing 11 is seated, the pins 74, 75 engage the annular groove 76 to retain the pump housing in position against the receiving collar 68. An annular gasket 73 seals the pump housing 11 to the collar 68 to thereby prevent the entry of any fluids into the interior of the cabinet that might damage motor 78 or its associated electronics. Motor 78 is equipped with a splined or hexagonal drive means 79 which engages a similar matching recess in the lower portion of rotor 30 illustrated as 31*a* in FIGS. 8 and 9. It should be noted that the resilient bias of the spring loaded pin 74, 75 will operate on the chamber on either side of groove 76 to force the pump housing 11 downwardly and thereby compress the annular gasket 73. When it is desired to clean the pump, the pump housing is pulled upwardly with a force sufficient to compress spring-loaded pins 74, 75, and the housing may be withdrawn for cleaning.

The foregoing description of the improved roller pump is for the purpose of illustrating the invention, and is not intended to be exhaustive or to limit the invention to the specific embodiments or measurements chosen. They were chosen and described in order to explain the principles of the invention and their practical application, to enable those skilled in the art to use the invention. The scope of the invention is to be defined in accordance with the following pending claims.

What is claimed is:

1. An improved peristaltic roller pump for pumping fluids through a flexible tubing, said pump comprising (a) a housing having an internal semicylindrical pump reaction wall of constant radius partially surrounding a central rotational axis, said housing having means adjacent opposite ends of said semicylindrical wall to releasably secure an arcuate portion of a flexible tubing against said wall, (b) a rotor mounted within said housing for rotation about said central axis, said rotor adapted for releasable engagement with a pump motor, (c) first and second pump rollers mounted on first and second reciprocal pump arms, said pump arms reciprocating along axes parallel to one another on either side of, and perpendicular to said central axis, the rotational axes of said rollers being spaced substantially 180° from one another, with each of said rollers having a length and a diameter, (d) cam means mounted between said rotor and said pump arms to reciprocally position and secure said rollers a desired distance from said reaction wall, (e) first surge release radius formed on each end of said semicylindrical wall, with the first surge radius being a function of the roller diameter, the transistion points between first surge release radii and the constand radius of said semicylindrical wall being spaced 180° from one another.

2. An improved peristaltic roller pump as claimed in claim 1 which further includes a second surge suppressing radius formed on the exterior of each of said first surge suppressing radii, said second radius being a function of the wall thickness of a flexible tubing intended for use in said pump.

3. An improved peristaltic roller pump as claimed in claim 1 wherein the function relating the first surge radii to the roller diameter is $$r_1 = d_r/2$$

wherein $r_1$ is the first surge release radius and $d_r$ is the diameter of the rollers.

4. An improved peristaltic roller pump as claimed in claim 2 wherein the function relating the second surge radius to a tubing wall thickness is $r_2 = W_t$ and $r_2 = r_1$ wherein $r_1$ is the first surge radius, $r_2$ is the second surge radius, and $W_t$ is the wall thickness of a tubing intended for use in said pump.

5. An improved peristaltic roller pump as claimed in claim 1 or 2 or 3 or 4 wherein said pump rotor further comprises a pair of angled sweep vanes mounted in front of each roller, said vanes being angled to define a discharge throat with the spacing of said vanes at said throat being equal to or less than the length of said rollers.

6. An improved peristaltic roller pump for pumping fluids through a flexible tubing, said pump comprising:

(a) a housing having an internal semicylindrical pump reaction wall of constant radius partially surrounding a central rotational axis, said housing having means adjacent opposite ends of said semicylindrical wall to releasably secure an arcuate portion of a flexible tubing against said wall, (b) a rotor mounted within said housing for rotation about said central axis, said rotor adapted for releasable engagement with a pump motor, (c) first and second pump rollers mounted on first and second reciprocal pump arms, said pump arms reciprocating along axes parallel to one another on either side of, and perpendicular to, said central axis, the rotational axes of said rollers being spaced substantially 180° from one another, with each of said rollers having a length and a diameter, (d) cam means mounted between said rotor and said pump arms to reciprocally position and secure said rollers a desired distance from said reaction wall, (e) first and second pairs of angled sweep vanes mounted on said rotor with one pair of vanes in front of each roller to direct a flexible tubing between said roller and said wall, each pair of vanes being spaced and angled with respect to each other to define a discharge throat, with the spacing of said vanes at said throat being equal to or less than the length of said rollers.

7. An improved peristaltic pump as claimed in claim 6 wherein each of said vanes has a curved exterior end wherein said curve conforms to the curve of said semicylindrical wall as the vanes are rotated by said rotor.

8. An improved peristaltic roller pump as claimed in claim 6 which further includes a first surge release radii formed on either end of said semicylindrical wall, the first surge radius release radii being a function of the roller diameter, with the transition points between the surge release radii and the constant radius of said semicylindrical wall being spaced substantially 180° from one another.

9. An improved peristaltic roller pump as claimed in claim 8 wherein the function relating the first surge for these radii to the roller diameter is $$r_1 = d_r/2$$

wherein $r_1$ is the first surge release radius, and $d_r$ is the diameter of the roller.

10. An improved peristaltic roller pump as claimed in claim 8 or 9 wherein a second surge suppressing radius is formed on the exterior of each of said first surge suppressing radii, wherein the radius is related to a tubing wall thickness, wherein $r_2 = W_t$ and $r_2 = r_1$ wherein $r_1$ is the first surge release radii, $r_2$ is a second surge release radii, and $W_t$ is the tubing wall thickness of a tubing intended for use in said pump.

11. An improved peristaltic roller pump for pumping fluids through a flexible tubing, said pump comprising:

(a) a housing having an internal semicylindrical pump reaction wall of constant radius partially surrounding a central rotational axis, said housing having means adjacent opposite ends of said cylindrical wall to releasably secure an arcuate portion of a flexible tubing against said wall, (b) a rotor mounted within said housing for rotation about said central axis, said rotor adapted for releasable engagement with a pump motor, (c) first and second pump rollers mounted on first and second reciprocal pump arms, said arms being mounted for reciprocation within said rotor, and reciprocating along axes, parallel to one another on either side of said central axis, each of said arms defining a slot therein at the rotor end thereof, (d) cam means mounted on said rotor and engaging said slots defined in said pump arms, said cam means being releasably secured to said rotor and engaging said slots to reciprocate said arms when rotated with respect to said rotor to thereby position and secure said rollers at a desired distance from said reaction wall.

12. An improved peristaltic roller pump as claimed in claim 11 which further includes a first surge release radii formed on either end of said semicylindrical wall, the first radius being a function of the roller diameter with the transition points between the surge release radius and the constant radius of said semicylindrical wall being spaced substantially 180° apart.

13. An improved peristaltic roller pump as claimed in claim 12 wherein a second surge suppressing radius is formed on the exterior of each of said first surge suppressing radius, the second surge suppressing radius being a function the wall thickness of a flexible tubing intended for use therein.

14. An improved peristaltic roller pump as claimed in claim 13 wherein the function relating the first surge release radius to the roller diameter is $r_1 = d_r/2$ wherein $r_1$ is the first surge release radius and $d_r$ is the diameter of the roller.

15. An improved peristaltic roller pump as claimed in claim 11 or 12 or 13 or 14 wherein the pump rotor further comprises a pair of angled sweep vanes mounted in front of each roller, said vanes being angled to define a discharge throat with the spacing of said vanes at said throat being equal to or less than the length of said rollers.

* * * * *